US011253425B2

(12) United States Patent
Peck et al.

(10) Patent No.: US 11,253,425 B2
(45) Date of Patent: Feb. 22, 2022

(54) PAIN MANAGEMENT DEVICE

(71) Applicant: Rezzimax, LLC, Richmond, UT (US)

(72) Inventors: Sharik Peck, Richmond, UT (US); Cheryl Peck, Richmond, UT (US)

(73) Assignee: Rezzimax, LLC, Richmond, UT (US)

( * ) Notice: Subject to any disclaimer, the term of this patent is extended or adjusted under 35 U.S.C. 154(b) by 336 days.

(21) Appl. No.: 16/471,109

(22) PCT Filed: Aug. 10, 2018

(86) PCT No.: PCT/US2018/046377
§ 371 (c)(1),
(2) Date: Jun. 19, 2019

(87) PCT Pub. No.: WO2020/032980
PCT Pub. Date: Feb. 13, 2020

(65) Prior Publication Data

US 2021/0330548 A1 Oct. 28, 2021

(51) Int. Cl.
*A61H 23/02* (2006.01)
*A61H 7/00* (2006.01)

(52) U.S. Cl.
CPC ..... *A61H 23/0254* (2013.01); *A61H 7/005* (2013.01); *A61H 2201/0107* (2013.01); *A61H 2201/0153* (2013.01); *A61H 2201/1676* (2013.01); *A61H 2201/1692* (2013.01); *A61H 2201/5005* (2013.01)

(58) Field of Classification Search
CPC .... A61H 23/00; A61H 23/02; A61H 23/0254; A61H 7/002–005; A61H 39/00–086; A61H 2039/005
USPC ..... 601/48
See application file for complete search history.

(56) References Cited

U.S. PATENT DOCUMENTS

D504,954 S * 5/2005 Park ..... D24/200
D709,195 S * 7/2014 Peck ..... D24/143
2007/0123952 A1* 5/2007 Strother ..... A61N 1/36017 607/48

(Continued)

FOREIGN PATENT DOCUMENTS

CN 2668105 Y * 1/2005

OTHER PUBLICATIONS

Translation of CN 2668105Y (Year: 2005).*

*Primary Examiner* — Valerie L Woodward
*Assistant Examiner* — Paige Kathleen Bugg
(74) *Attorney, Agent, or Firm* — Preston P. Frischknecht; Project CIP

(57) ABSTRACT

The invention relates to a pain management device with a body portion having an hourglass shaped, elongated handle with an arm at one end for releasably attaching one or more treatment attachments, one or more generally planar scraping wings for Gua Sha treatment, and a motor inside configured to impart vibration in each of several modes optimized for vibration therapy. The invention may also include a kit with the pain management device, and one or more treatment attachments designed for unilateral or bilateral vibration application adjacent to trigeminal and/or vagus nerves. The treatment attachment may have two or more pivotable arms that extend along an axis generally perpendicular to the elongated handle when attached to the pain management device.

16 Claims, 8 Drawing Sheets

(56) References Cited

U.S. PATENT DOCUMENTS

| | | | | |
|---|---|---|---|---|
| 2011/0071445 | A1* | 3/2011 | Imboden | A61H 19/44 601/46 |
| 2016/0022529 | A1* | 1/2016 | Abdo | A61H 15/0092 601/119 |
| 2016/0074278 | A1* | 3/2016 | Muench | A61H 23/02 601/46 |
| 2017/0319427 | A1* | 11/2017 | Udhardt | A61H 15/0085 |
| 2017/0340514 | A1* | 11/2017 | Denisenko | A61N 5/0619 |
| 2018/0040255 | A1* | 2/2018 | Freeman | A61H 31/00 |
| 2018/0207054 | A1* | 7/2018 | Sitsihovskiy | A61N 2/002 |
| 2019/0070057 | A1* | 3/2019 | Conner | A61H 1/00 |

* cited by examiner

PAIN MANAGEMENT DEVICE

TECHNICAL FIELD AND INDUSTRIAL APPLICABILITY OF THE INVENTION

The invention relates to a new pain management device comprising: a body portion having an hourglass shaped, elongated handle with an arm at one end for releasably attaching one or more treatment attachments, the body portion further having one or more generally planar scraping wings for Gua Sha treatment, and a motor inside the body portion configured to impart vibration to the body portion in each of several modes optimized for vibration therapy. The invention may also include a kit with the pain management device, and one or more treatment attachments designed for unilateral and/or bilateral vibration application adjacent to trigeminal and/or vagus nerves, and having two or more pivotable arms that extend along an axis generally perpendicular to the elongated handle when attached to the pain management device.

BACKGROUND OF THE INVENTION

People experience undesirable fear, pain, anxiety, and inflammation in countless situations. Examples abound in dental treatment environments and for sufferers of temporomandibular joint dysfunction (TMJD), craniofacial pain, myofascial pain syndrome, headaches and migraines, and other localized myalgia. In many of these examples, the trigeminal and vagus nerves play a critical role in communicating and either up- or down-regulating symptoms within the nervous system. Importantly, studies have shown that conservative and specific nerve stimulation—such as bilateral application of vibration adjacent to these nerves at the masseter muscle—may significantly reduce negative symptoms. In particular, study results describe related physiology and mechanisms in more detail and show that vibration treatment may reduce stiffness, strain, and/or pain responses by up to fifty percent. See, e.g., Peck et al., *An Understanding of the Trigeminal/Vagus Nerve Can Help One Tune Out Pain and Fear*, Oral Health (Mar. 1, 2018).

The vibration treatment described is relatively new. So, there are few tools or instruments designed for dental or physical therapist professionals to implement it. The Rezzimax® Tuner is one example of a tool specifically adapted for the vibration treatment set forth herein. However, as treatment develops, there is further need for a tool that is even more versatile and that incorporates other treatment principles and methods in combination with a variety of optimized vibration modes.

One desired and compatible pain treatment method is Gua Sha. Gua Sha comes from the Chinese word for scraping. Gua Sha aims to move energy, known as qi or chi, around the body by using a blunted tool to rub the skin in long strokes, applying enough pressure to create minor bruising. According to traditional Chinese medicine, qi or chi is energy that flows through the body. A person's qi should be balanced and flowing freely to ensure their health and wellbeing. Qi can become blocked, causing pain or tension in the muscles and joints. Blood stasis or stagnation may also contribute to pain and illness. Therefore, Gua Sha aims to move blocked energy, blood stasis, or stagnation to relieve aches, stiffness or symptoms. Gua Sha techniques may also help to break down scar or connective tissue, improving movement in the joints. Many western physical therapists use Gua Sha tools to perform instrument assisted soft tissue mobilization (IASTM).

Accordingly, based on the above, a tool that merges the capability of nerve stimulation in the head, face, and mouth, together with Gua Sha concepts and tool design for treatment of other areas of the body, and which provides optimal and research-proven vibration modes, is needed and would be extremely useful in pain management.

DISCLOSURE OF THE INVENTION

In accordance with the above, a new pain management device is provided, comprising: a body portion with an hourglass shaped, elongated handle with an arm at one end for releasably attaching one or more treatment attachments, the body portion further having one or more generally planar scraping wings for Gua Sha treatment, and a motor inside the body portion configured to impart vibration to the body portion in each of several modes optimized for vibration therapy. The invention may also include a kit with the pain management device, and one or more treatment attachments, including one designed for bilateral vibration application adjacent to trigeminal and/or vagus nerves, and having two or more pivotable arms that extend along an axis generally perpendicular to the elongated handle when attached to the pain management device.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings may not be drawn to scale. The invention will be described and explained with additional specificity and detail through use of the accompanying drawings in which.

DETAILED DESCRIPTION AND MODES FOR CARRYING OUT THE INVENTION

Figure 1:
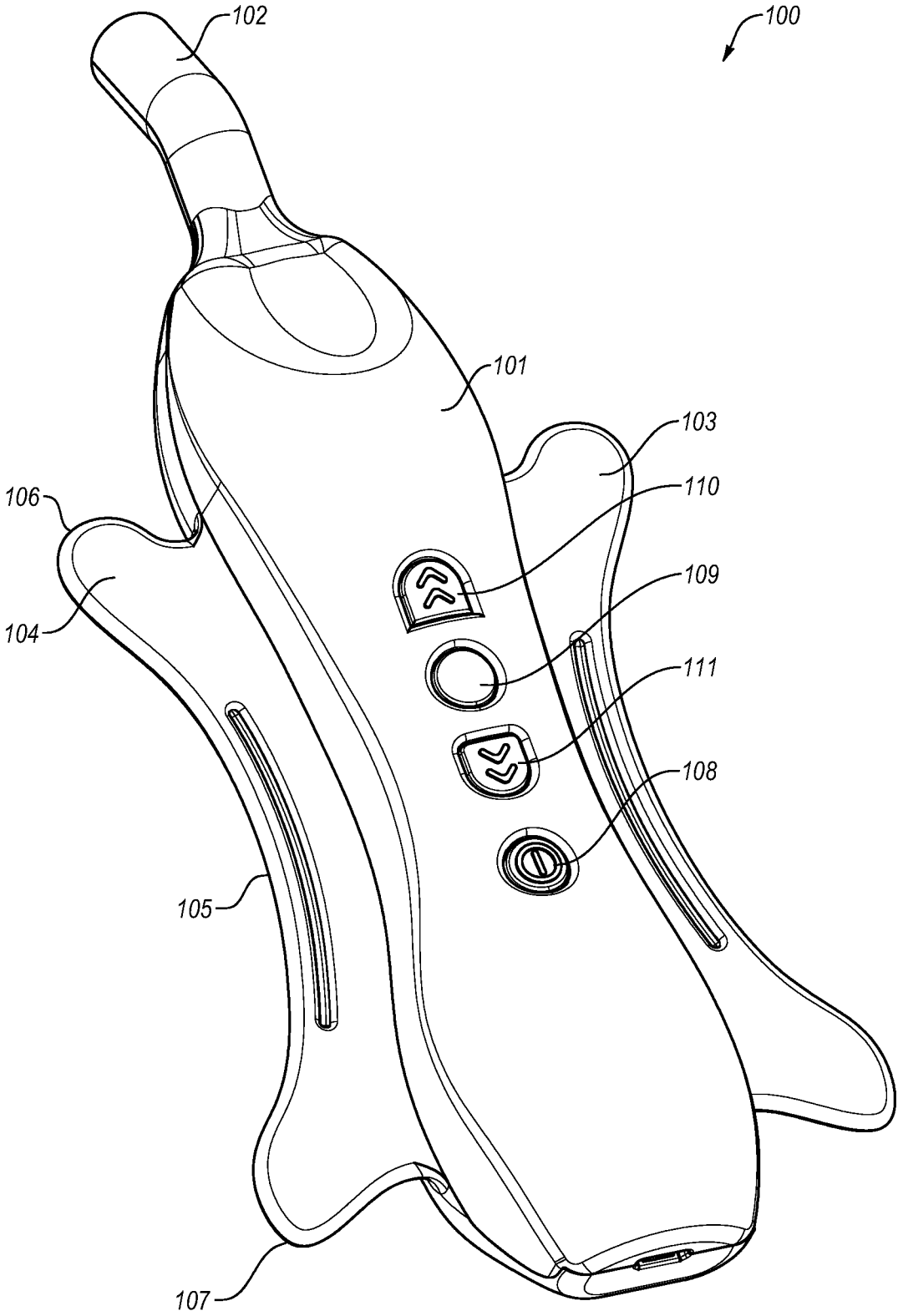
FIG. 1 is a perspective view of a first embodiment of a pain management device.
Figure 4:
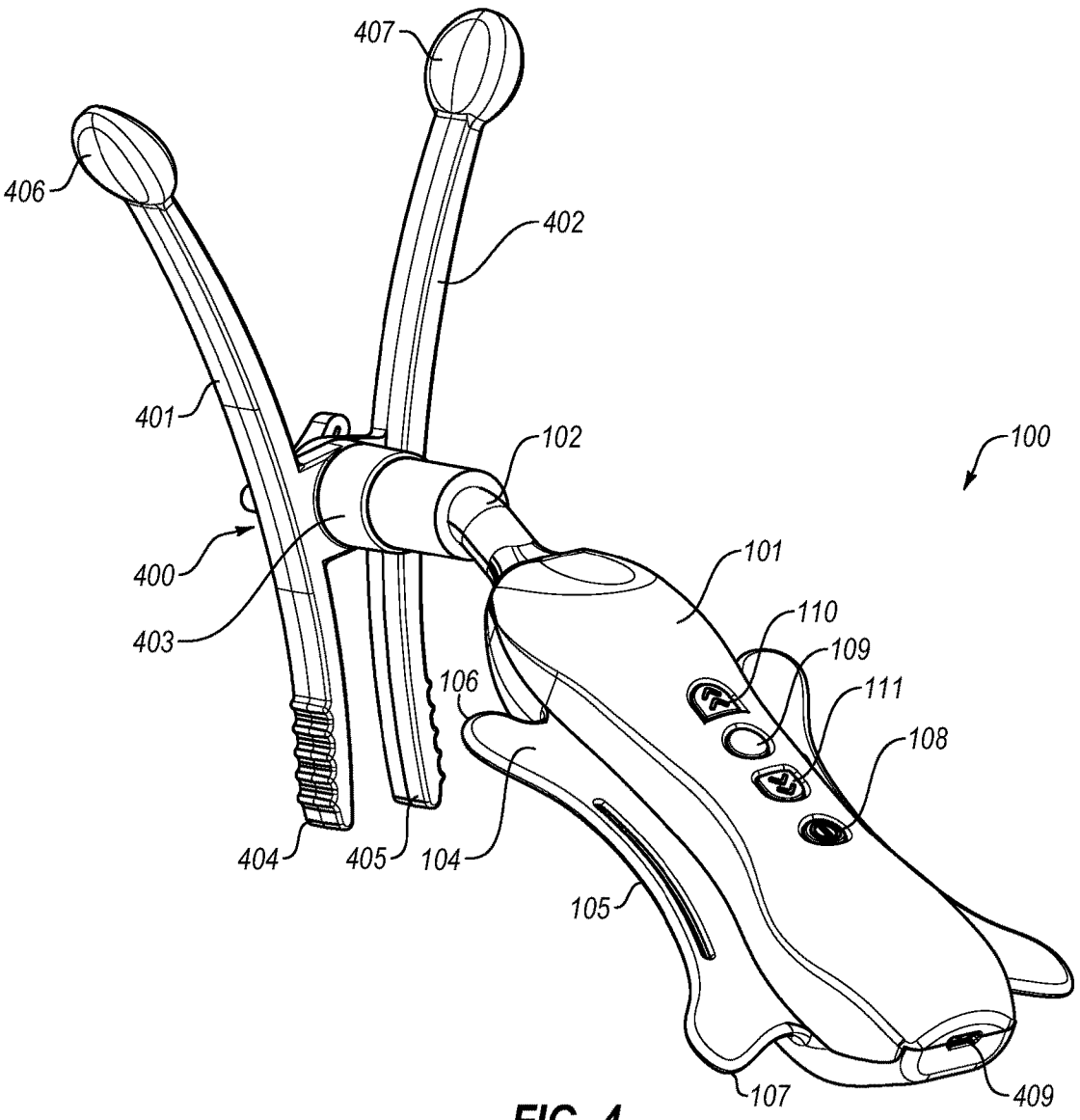
FIG. 4 is a perspective view of a first embodiment of a pain management device with a treatment attachment.

The present invention in its various embodiments, some of which are depicted in the figures herein, is a pain management device. Referring now to FIG. 1, the pain management device includes a body portion 100 with an hourglass shaped, elongated handle 101 and an arm 102 at one end. Referring briefly to FIG. 4, in various embodiments, arm 102 is configured to releasably attach one or more treatment attachments 400 to the device through male-female couplers, interference fit, or any other number of attachment methods. In the illustrated embodiment of FIG. 4, the one or more treatment attachments 400 is comprised of two or more pivotable arms 401, 402 that extend along an axis generally perpendicular to the elongated handle 101 when releasably attached to the pain management device.

Figure 3:
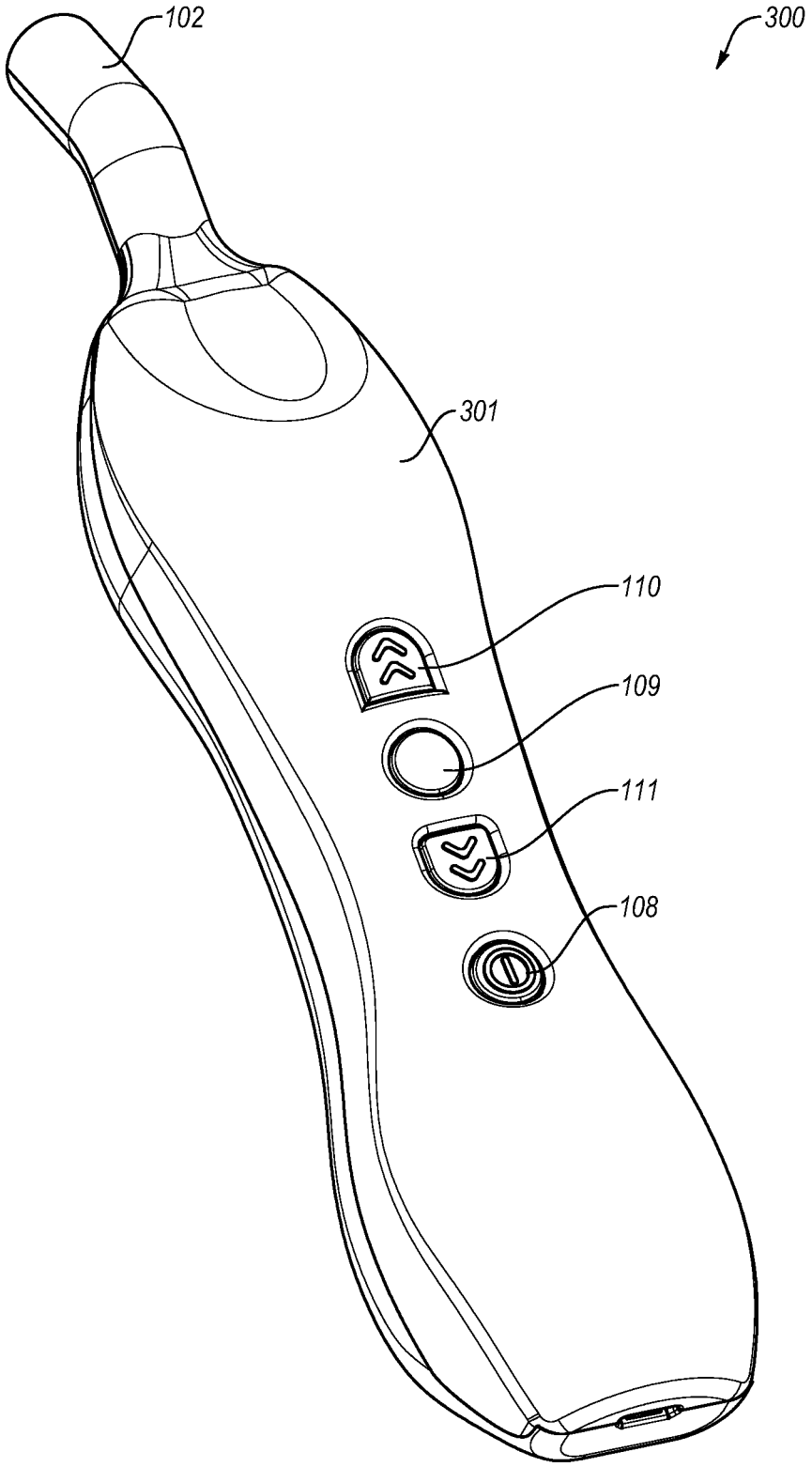
FIG. 3 is a perspective view of a second embodiment of a pain management device.

Referring back to FIG. 1, the body portion 100 has one or more first generally planar and elongated scraping massing wings 103 extending from the elongate handle 101. In certain embodiments, the body portion 100 has a second generally planar and elongated scraping wing 104, positioned opposite the first generally planar and elongated scraping wing 103 along the body portion 100. Within horizontal planes of the body, the scaping wing and/or wings generally have a substantially lesser cross-sectional height than the cross-sectional height of the elongate handle. One or more of each wing 103, 104 may have a continuous concave distal edge 105 and/or a first end with a first protuberance 106 and a second end with a second protuberance 107. Concave distal edges 105 may be shared by generally parallel wing faces. However, some embodiments exclude the described wings, such as that shown in FIG. 3.

Figure 2:
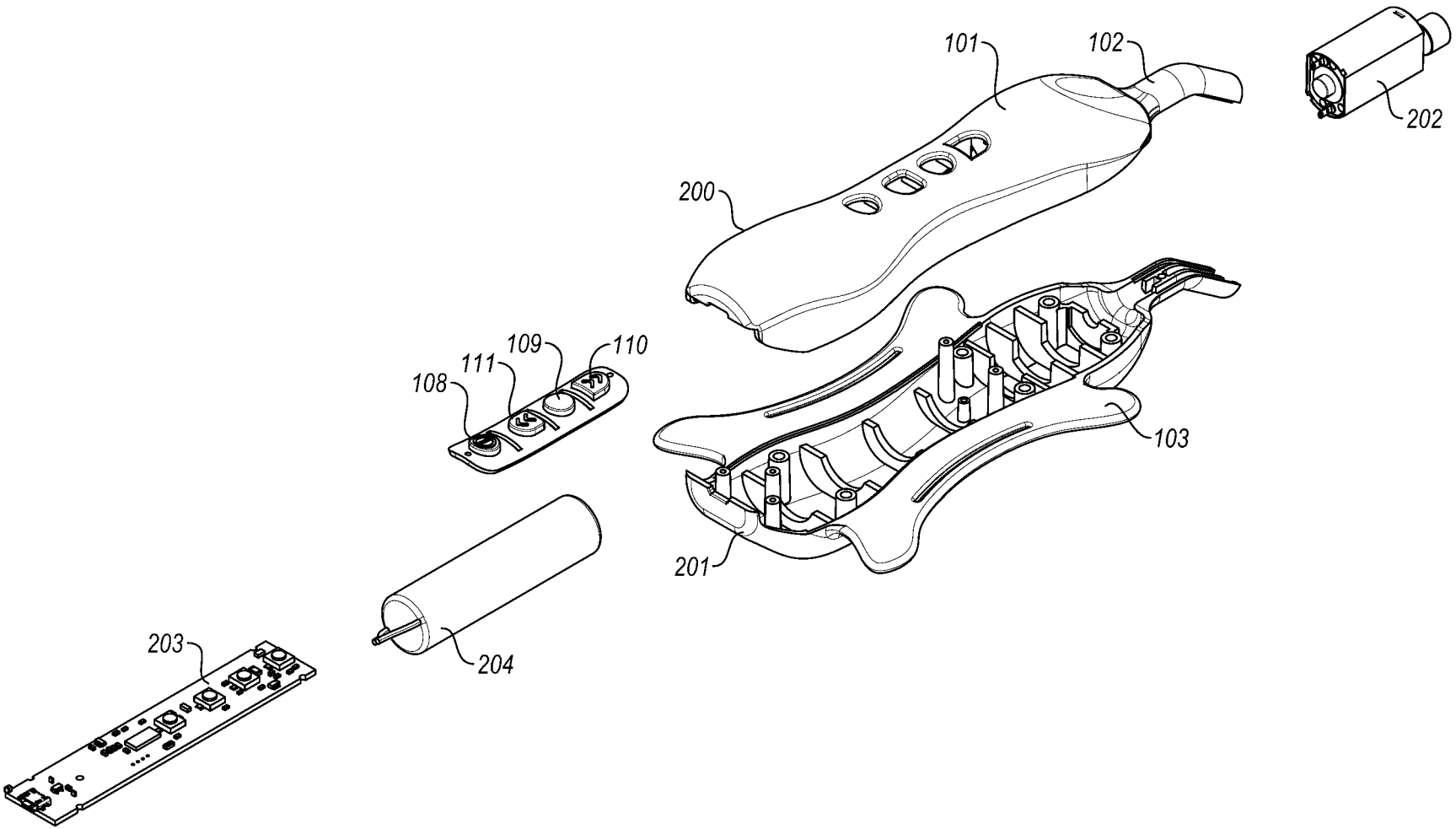
FIG. 2 is an exploded view of a first embodiment of a pain management device.

Referring now to FIG. 2, the pain management device also comprises a motor 202 inside the body portion 200, 201, the motor 202 configured to impart vibration to the body portion 200, 201 when the pain management device is in operation. A circuit board 203 is also inside the body portion 200, 201, and is in communication with, and configured to control operation of (e.g. actuation, intensity, frequency, etc.) the motor 202. The pain management device also contains a rechargeable power supply 204 connected to the motor 202 and/or circuit board 203. The power supply 204 may be powered by corded or cordless means. In the illustrated embodiment, the power supply 204 is powered through a micro-USB connection (see FIG. 4, 409).

Circuit board 203 may receive pressure or touch activated user input from one or more control buttons 108-111 located on the body portion 101. For example, power button 108 may turn the pain management device on and off. A mode button 109 allows a user to select to operate the pain management device within a predetermined mode from among a menu of modes, each with different and unique vibration patterns and dynamics optimal for the vibration therapy and described below. Up 110 and down 111 buttons allow a user to respectively increase or decrease the vibration or intensity of the pain management device.

Figure 5:
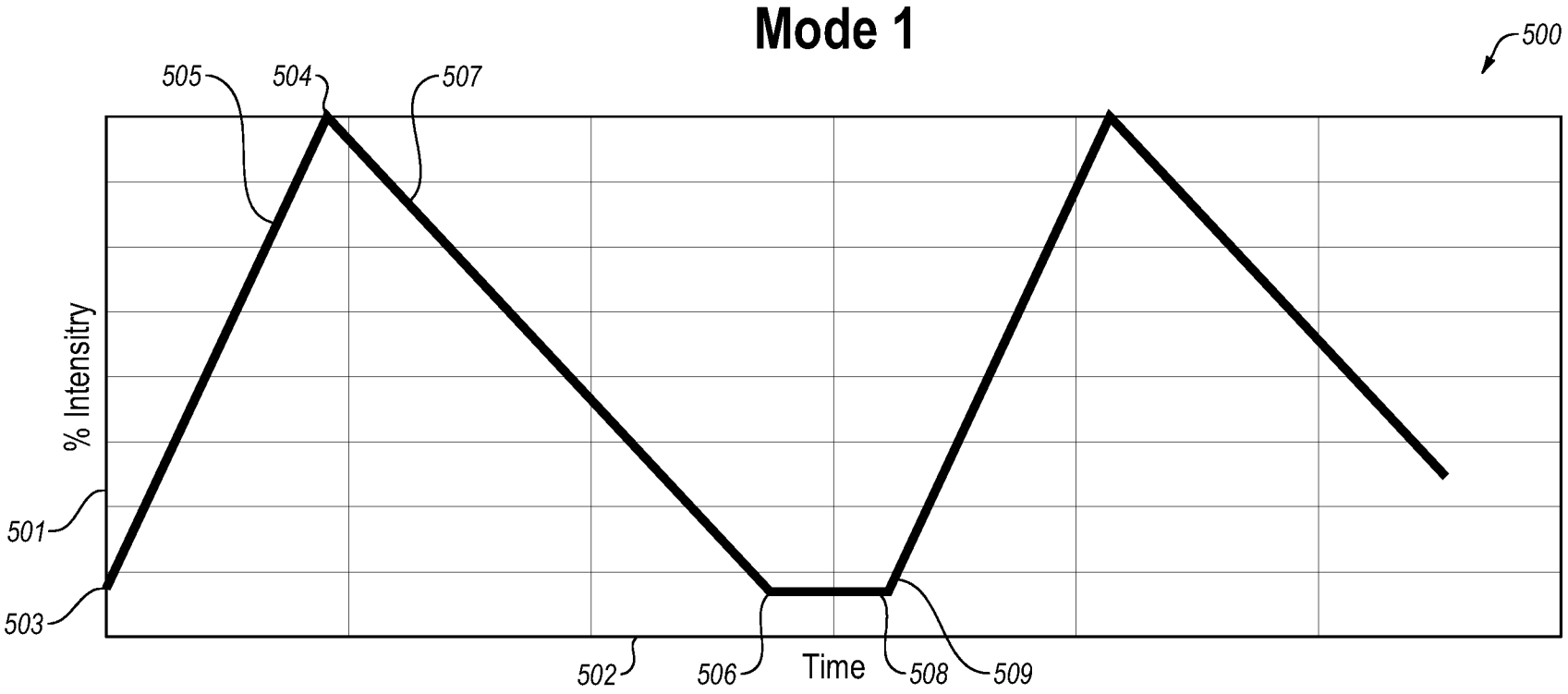
FIG. 5 is a graph showing a second vibration mode in one embodiment of a pain management device.

The circuit board 203 is configured to operate the motor 202 to impart vibration in the range of 25 to 110 Hz in one or more modes of operation, including pre-programmed modes, which correspond to vibration therapy techniques. For example, in a default or normal mode (not shown) a user manually selects the intensity of the imparted vibration. FIGS. 5-8 show the dynamics of various other exemplary modes in graph form, with imparted vibration intensity—represented on the Y axis—over time—represented on the X axis. Referring now to FIG. 5, in a first programmed ramp down 500, the intensity of the imparted vibration 501 begins at a first low intensity 503, then increases to a first maximum intensity 504 at a first rate 505, then decreases to the first minimum intensity 506 at a second rate 507 that is slower than the first rate 505, resting 508 at the minimum intensity 506, optimally for between 5 and 10 seconds, and then repeats 509.

Figure 6:
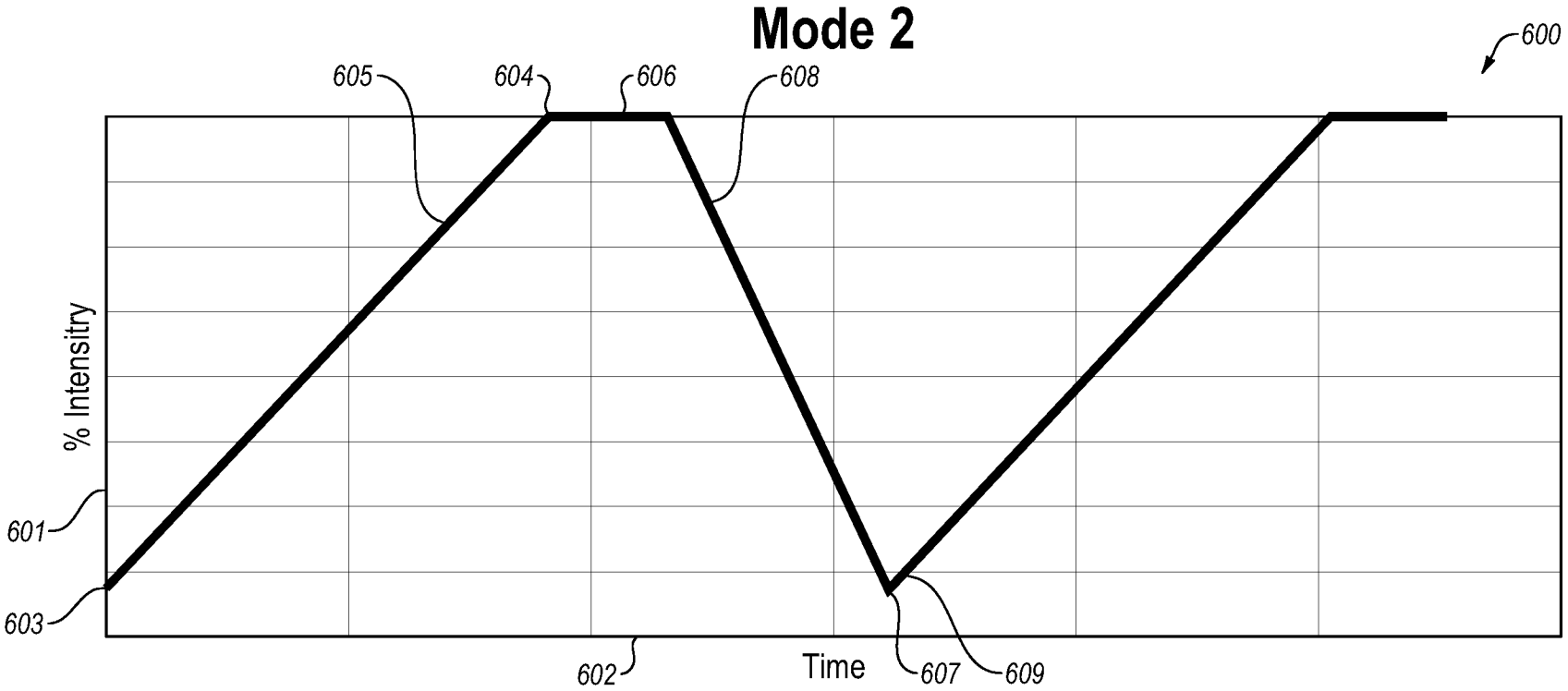
FIG. 6 is a graph showing a third vibration mode in one embodiment of a pain management device.

Referring now to FIG. 6, in a second programmed ramp up mode 600, the intensity of the imparted vibration 601 begins at a first low intensity 603, then increases to a first maximum intensity 604 at a first rate 605, resting 606 at the maximum intensity 604, optimally for between 5 and 10 seconds, then decreases to the first minimum intensity 607 at a second rate 608 that is faster than the first rate 605, and then repeats 609.

Figure 7:
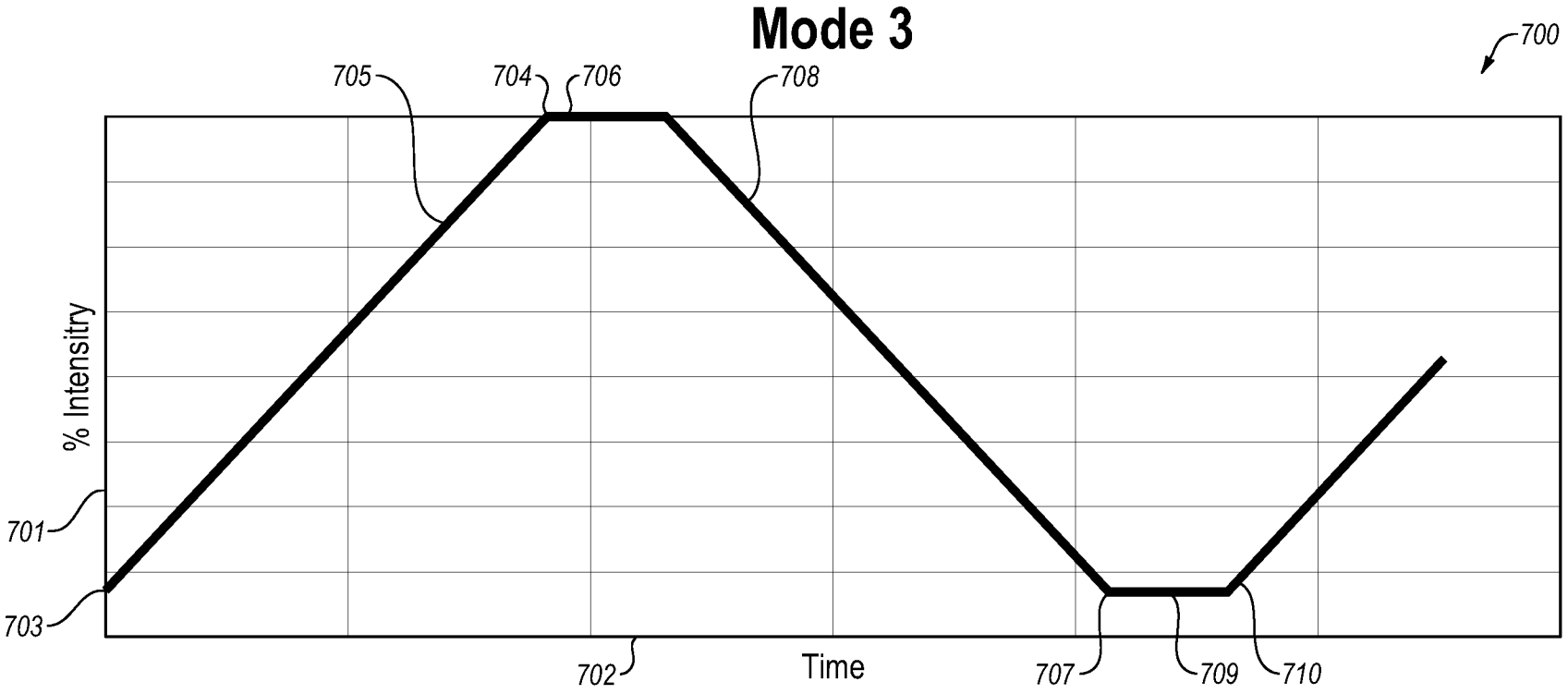
FIG. 7 is a graph showing a fourth vibration mode in one embodiment of a pain management device.
Figure 8:
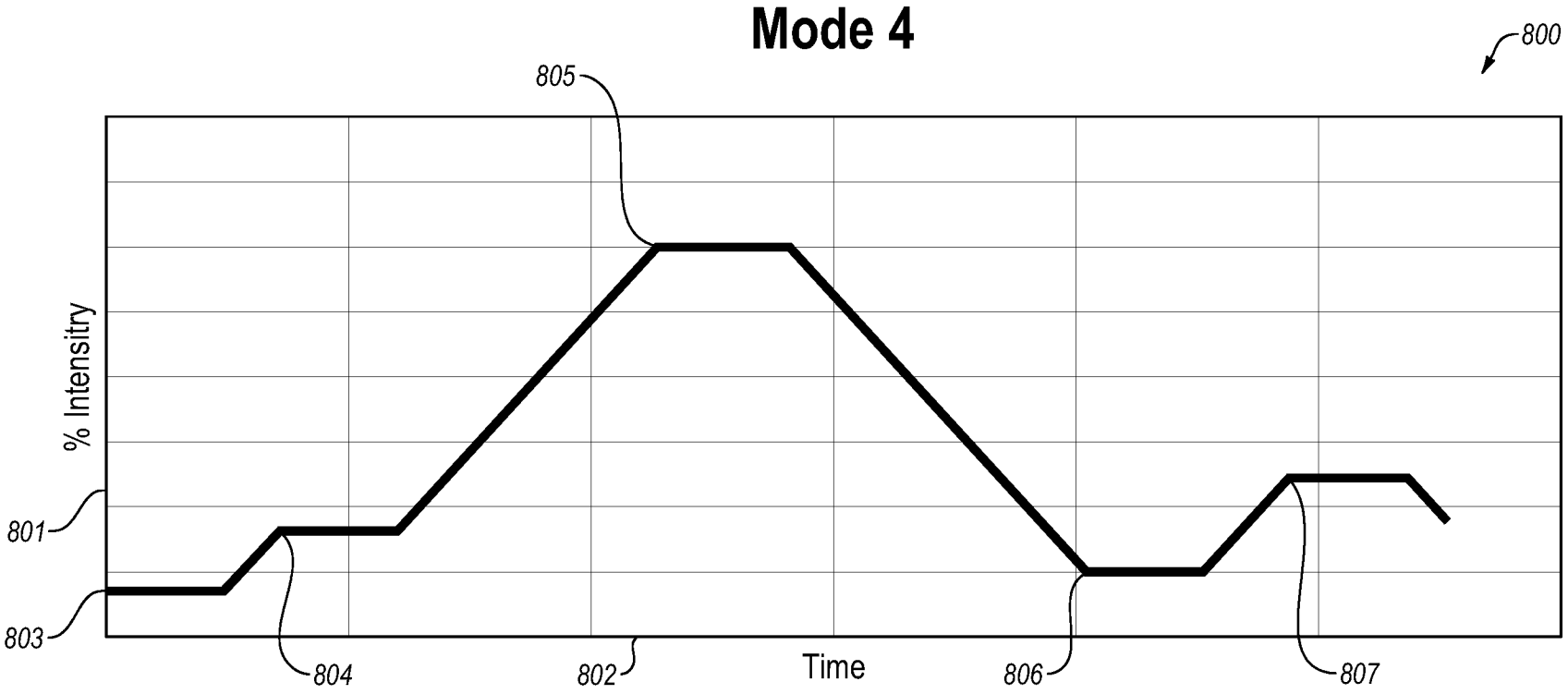
FIG. 8 is a graph showing a fifth vibration mode in an embodiment of a pain management device.

Referring now to FIG. 7, in third programmed ramp up and down mode 700, the intensity of the imparted vibration 701 begins at a first low intensity 703, then increases to a first maximum intensity 704 at a first rate 705, resting at the maximum intensity 706, optimally for between 5 and 10 seconds, then decreases to the first minimum intensity 707 at the first rate 708, resting at the minimum intensity 709, optimally for between 5 and 10 seconds, and then repeats 710. Referring now to FIG. 8, in a fourth programmed random mode 800 the intensity of the imparted vibration 801 occurs at varying levels 803-807 over time 802 and holds for between 5 and 10 seconds at each level before moving to a different level.

Thus configured, embodiments of the present invention provide a new pain management device with planar scraping wings for Gua Sha treatment, a motor inside the body portion configured to impart vibration to the body portion in each of several modes optimized for vibration pain therapy, and a releasable attachment designed for bilateral vibration application adjacent to trigeminal and/or vagus nerves.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A pain management device comprising:

a body portion with a generally hourglass shaped, elongate handle and an arm at one end, the arm configured to releasably attach one or more treatment attachments, the body portion further having first and second generally planar and elongate scraping wings extending from the elongate handle, the first and second generally planar and elongate scraping wings each having substantially lesser cross-sectional height than the cross-sectional height of the elongate handle in horizontal plane;

a releasably attachable treatment attachment with two or more pivotable arms that extend along an axis generally perpendicular to the elongate handle when attached to the pain management device;

a motor inside the body portion, the motor configured to impart vibration to the body portion; and a circuit board in communication with and configured to control operation of the motor.

2. The pain management device of claim 1 further comprising a rechargeable power supply connected to the motor.

3. The pain management device of claim 1, the first and second generally planar and elongate scraping wings each further having a concave distal edge.

4. The pain management device of claim 3, wherein the concave distal edge of each of the first and second generally planar and elongate scraping wings has a first apex with a protuberance and a second apex with a protuberance.

5. The pain management device of claim 1, the circuit board further configured to operate the motor to impart vibration in a mode selected from the mode group consisting of:

a normal mode wherein a user manually selects the intensity of the imparted vibration;

a ramp down mode wherein the intensity of the imparted vibration begins at a first low intensity, then increases to a first maximum intensity at a first rate, then decreases to first minimum intensity at a second rate that is slower than the first rate, resting at the minimum intensity for between 5 and 10 seconds, and then repeats;

a ramp up mode wherein the intensity of the imparted vibration begins at a first low intensity, then increases to a first maximum intensity at a first rate, resting at the maximum intensity for between 5 and 10 seconds, then decreases to the first minimum intensity at a second rate that is faster than the first rate, and then repeats;

a ramp up/down mode wherein the intensity of the imparted vibration begins at a first low intensity, then increases to a first maximum intensity at a first rate, resting at the maximum intensity for between 5 and 10 seconds, then decreases to the first minimum intensity at the first rate, resting at the minimum intensity for between 5 and 10 seconds, and then repeats; and a random mode wherein the intensity of the imparted vibration occurs at varying levels, and holds for between 5 and 10 seconds at each level before moving to a different level.

6. The pain management device of claim 3, the concave distal edge of each of the first and second generally planar and elongate scraping wings further being continuous and shared by generally parallel wing faces.

7. A pain management device comprising:

a body portion with a generally hourglass shaped, elongate handle and an arm at one end, the arm configured to releasably attach one or more treatment attachments, the body portion further having first and second generally planar and elongate scraping wings extending away from the elongate handle, the first and second generally planar and elongate scraping wings further each having a concave distal edge and substantially lesser cross-sectional height than the cross-sectional height of the elongate handle in horizontal plane;

a releasably attachable treatment attachment with two or more pivotable arms that extend along an axis generally perpendicular to the elongate handle when attached to the pain management device;

a motor inside the body portion, the motor configured to impart vibration to the body portion; and a circuit board, in communication with and configured to control operation of the motor.

8. The pain management device of claim 7, further comprising a rechargeable power supply connected to the motor.

9. The pain management device of claim 7, wherein the first and second generally planar and elongate scraping wings generally positioned opposite each other on the body portion.

10. The pain management device of claim 9, wherein the concave distal edge of each of the first and second generally planar and elongate scraping wings has a first end with a first protuberance and a second end with a second protuberance.

11. The pain management device of claim 7, the circuit board configured to operate the motor to impart vibration in each of the following modes:

a first mode wherein a user manually selects the intensity of the imparted vibration;

a second mode wherein the intensity of the imparted vibration begins at a first low intensity, then increases to a first maximum intensity at a first rate, then decreases to the first minimum intensity at a second rate that is slower than the first rate, resting at the minimum intensity for between 5 and 10 seconds, and then repeats;

a third mode wherein the intensity of the imparted vibration begins at a first low intensity, then increases to a first maximum intensity at a first rate, resting at the maximum intensity for between 5 and 10 seconds, then decreases to the first minimum intensity at a second rate that is faster than the first rate, and then repeats;

a fourth mode wherein the intensity of the imparted vibration begins at a first low intensity, then increases to a first maximum intensity at a first rate, resting at the maximum intensity for between 5 and 10 seconds, then decreases to the first minimum intensity at the first rate, resting at the minimum intensity for between 5 and 10 seconds, and then repeats; and a fifth mode wherein the intensity of the imparted vibration occurs at varying levels, and holds for between 5 and 10 seconds at each level before moving to a different level.

12. The pain management device of claim 7, the concave distal edge of each of the first and second generally planar and elongate scraping wings further being continuous and shared by generally parallel wing faces.

13. A kit comprising a pain management device having a body portion with a generally hourglass shaped, elongate handle and an arm at one end, the arm configured to releasably attach one or more treatment attachments, the body portion further having first and second generally planar and elongate scraping wings extending away from the elongate handle, the first and second generally planar and elongate scraping wings further having a concave distal edge and substantially lesser cross-sectional height than the cross-sectional height of the elongate handle in horizontal plane;

a motor inside the body portion, the motor configured to impart vibration to the body portion;

a circuit board, in communication with and configured to operate the motor; and one or more treatment attachments, the one or more treatment attachments releasably attachable to the arm and having two or more pivotable arms that extend along an axis generally perpendicular to the elongate handle when attached to the pain management device.

14. The kit of claim 13, wherein circuit board of the pain management device is configured to operate the motor to impart vibration in each of the following modes:

a first mode wherein a user manually selects the intensity of the imparted vibration;

a second mode wherein the intensity of the imparted vibration begins at a first low intensity, then increases to a first maximum intensity at a first rate, then decreases to the first minimum intensity at a second rate that is slower than the first rate, resting at the minimum intensity for between 5 and 10 seconds, and then repeats;

a third mode wherein the intensity of the imparted vibration begins at a first low intensity, then increases to a first maximum intensity at a first rate, resting at the maximum intensity for between 5 and 10 seconds, then decreases to the first minimum intensity at a second rate that is faster than the first rate, resting, and then repeats;

a fourth mode wherein the intensity of the imparted vibration begins at a first low intensity, then increases to a first maximum intensity at a first rate, resting at the maximum intensity for between 5 and 10 seconds, then decreases to the first minimum intensity at the first rate, resting at the minimum intensity for between 5 and 10 seconds, and then repeats; and a fifth mode wherein the intensity of the imparted vibration occurs at varying levels, and holds for between 5 and 10 seconds at each level before moving to a different level.

15. The kit of claim 14, further comprising instructions for using the pain management device in each of the modes.

16. The pain management device of claim 13, the concave distal edge of each of the first and second generally planar and elongate scraping wings further being continuous and shared by generally parallel wing faces.

* * * * *